US010993297B2

(12) United States Patent
Kikuchi et al.

(10) Patent No.: US 10,993,297 B2
(45) Date of Patent: Apr. 27, 2021

(54) LIGHTING CIRCUIT AND VEHICULAR LAMP

(71) Applicant: Koito Manufacturing Co., Ltd., Tokyo (JP)

(72) Inventors: Satoshi Kikuchi, Shizuoka (JP); Takao Muramatsu, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 70 days.

(21) Appl. No.: 15/833,040

(22) Filed: Dec. 6, 2017

(65) Prior Publication Data

US 2018/0168013 A1 Jun. 14, 2018

(30) Foreign Application Priority Data

Dec. 13, 2016 (JP) ..... JP2016-241472
Apr. 14, 2017 (JP) ..... JP2017-080809

(51) Int. Cl.
*H05B 45/10* (2020.01)
*H05B 33/08* (2020.01)
*H05B 45/37* (2020.01)
*H05B 45/48* (2020.01)

(52) U.S. Cl.
CPC ..... *H05B 45/10* (2020.01); *H05B 33/08* (2013.01); *H05B 45/37* (2020.01); *H05B 45/48* (2020.01)

(58) Field of Classification Search
CPC ..... H05B 45/10; H05B 45/37; H05B 33/08; H05B 45/48; H05B 45/00; H05B 45/44; F21S 41/141; F21S 41/19; F21S 41/663; F21S 45/10; H02M 1/14; Y02B 20/383
See application file for complete search history.

(56) References Cited

U.S. PATENT DOCUMENTS

2012/0153833 A1* 6/2012 Mikani ..... H05B 45/37 315/122
2014/0084964 A1* 3/2014 Kawamoto ..... H03K 17/163 327/108
2015/0002040 A1* 1/2015 Malyna ..... H05B 47/10 315/201

FOREIGN PATENT DOCUMENTS

WO 2016/104319 A1 6/2016

* cited by examiner

*Primary Examiner* — Renan Luque
(74) *Attorney, Agent, or Firm* — Abelman, Frayne & Schwab

(57) ABSTRACT

A lighting circuit controls lighting/extinguishing of a light source. A driving circuit generates a driving current which is to be supplied to the light source. A clamp circuit clamps a voltage between both ends of the light source to a clamp level in a period in which the light source is to be turned off. The clamp level is defined to be higher than zero and lower than a critical pressure when the light source is turned on/off.

14 Claims, 13 Drawing Sheets

LIGHTING CIRCUIT AND VEHICULAR LAMP

CROSS-REFERENCE TO RELATED APPLICATIONS

This application is based on and claims priority from Japanese Patent Application Nos. 2016-241472 and 2017-080809, filed on Dec. 13, 2016 and Apr. 14, 2017, with the Japan Patent Office, the disclosures of which are incorporated herein in their entireties by reference.

TECHNICAL FIELD

The present disclosure relates to a lamp used for, for example, a vehicle.

BACKGROUND

Light sources such as laser diodes (LD) and light emitting diodes (LED) are used for various applications such as vehicular lamps, projectors, backlights of liquid crystal panels, illumination devices, and optical communication technologies.

FIG. 1 is a circuit diagram of a lighting circuit in the related art. The lighting circuit 1100 includes a driving circuit 1102 and a bypass switch 1104. The driving circuit 1102 supplies a driving current $I_{DRV}$ which is stabilized in a predetermined amount to a light source 1002. The bypass switch 1104 is connected in parallel with the light source 1002.

When the bypass switch 1104 is turned off, since the driving current $I_{DRV}$ flows to the light source 1002, the light source 1002 emits light. When the bypass switch 1104 is turned on, since the driving current $I_{DRV}$ flows to the light source 1104, the light source 1002 is turned off. Therefore, lighting/extinguishing of the light source 1002 may be switched by switching the bypass switch 1104. See, for example,

SUMMARY

For example, when a light source is used as a vehicular lamp or a backlight, dimming of the light source becomes possible by switching the light source 1002 to a frequency that the human eye cannot perceive and changing the duty ratio. The switching frequency used for general pulse width modulation (PWM) dimming is in the order of several tens to several hundreds of Hz, which may be implemented in the lighting circuit 1100 of FIG. 1.

However, it is difficult to switch the light source 1002 at a frequency higher than several kHz in the lighting circuit 1100 of FIG. 1.

The present disclosure has been made under the above-described circumstances and one of exemplary embodiments thereof provides a lighting circuit that is capable of switching a light source at high speed.

A certain aspect of the present disclosure relates to a lighting circuit of a light source. The lighting circuit includes: a driving circuit configured to generate a driving current to be supplied to the light source; and a clamp circuit configured to clamp a voltage between both ends of the light source to a clamp level which is defined to be higher than zero and lower than a critical pressure when the light source is turned on/off in a period in which the light source is to be turned off.

The voltage between both ends of the light source in the lighting period is $V_{ON}$, and the clamp level is $V_{CL}$. In this aspect, since the voltage between the both ends is clamped to the clamp level $V_{CL}$ in the extinguishing period of the light source, the variation width $\Delta V$ of the voltage of the both ends equals to $V_{ON}-V_{CL}$ when switching from off to on. By moving the $V_{CL}$ closer to a threshold voltage $V_{TH}$ of the turning-on/off of the light source, the variation width $\Delta V$ when switching from off to on may be reduced. Thus, the light source may be turned on for a short period of time. In addition, since the load fluctuation when viewed from the driving circuit may be reduced, restrictions on the design of the driving circuit may be alleviated.

The clamp circuit may immediately reduce the voltage between the both ends of the light source to substantially zero in response to an extinguishing instruction of the light source and then clamp the voltage to the clamp level. As a result, after the extinguishing instruction of the light source, the light source may be turned off for a short period of time.

The clamp circuit may include a first switch and a clamp resistor provided in series on a first path in parallel with the light source. When a resistance value of the first path is $R_1$, a threshold voltage of the light source is $V_{TH}$, and the driving current is $I_{DRV}$, a relation of $0<R_1 \times I_{DRV}<V_{TH}$ may be satisfied.

The clamp circuit may include the first switch provided on the first path that is in parallel with the light source. When the resistance value of the first path is $R_1$, a threshold voltage of the light source is $V_{TH}$, and the driving current is $I_{DRV}$, a relation of $0<R_1 \times I_{DRV}<V_{TH}$ is satisfied.

The clamp circuit may further include a second switch provided on a second path that is in parallel with the light source. The second switch may be turned on immediately after an extinguishing instruction of the light source, and may be turned off before a lighting instruction of the light source. As a result, switching from on to off may be performed at high speed.

The clamp circuit may include: a shaft transistor provided between the both ends of the light source; and a transistor control circuit configured to generate a voltage of a control terminal of the shaft transistor such that a voltage between the both ends of the light source becomes the clamp level in a period in which the light source is to be turned off.

The transistor control circuit may include a feedback circuit which brings the voltage between the both ends of the light source close to the clamp level by feedback. The voltage between the both ends of the light source may be clamped by configuring a so-called shaft regulator with the feedback circuit and the shaft transistor.

The transistor control circuit may also include a constant voltage circuit provided between the control terminal of the shaft transistor and a high potential side end.

The transistor control circuit may further include a third switch provided between the control terminal of the shaft transistor and a low potential side end of the light source, or between the control terminal of the shaft transistor and a low voltage terminal to which a predetermined low voltage is supplied. By turning on the third switch, the shaft transistor may be turned off (or turned on) immediately and the light source may be turned on/off instantaneously.

The transistor control circuit may further include a fourth switch provided between the control terminal of the shaft transistor and a high potential side end of the light source, or between the control terminal of the shaft transistor and a high voltage terminal to which a predetermined high voltage is supplied. By turning on the fourth switch, the shaft transistor may be turned on (or turned off) immediately and the light source may be turned on/off instantaneously.

Another aspect of the present disclosure relates to a vehicular lamp. The vehicular lamp may include a light source and any one of the lighting circuits that drive the light source as described above.

Further, any combination of the above-described components or replacement of the components or expressions of the present disclosure among, for example, a method, a device, and a system is also effective as an aspect of the present disclosure.

In addition, the description of this section does not explain all the features which are essential for the present disclosure, and therefore, the sub-combinations of the described features may also be included in the present disclosure.

According to a certain aspect of the present disclosure, a light source may be switched at high speed.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, exemplary embodiments of the present disclosure will be described with reference to the accompanying drawings. Equal or equivalent components, members, and processes in each of the drawings will be denoted by the same symbols, and overlapping descriptions thereof will be appropriately omitted. Further, the exemplary embodiment is not intended to limit the present disclosure thereto, but is illustrative of the present disclosure. All the features described in the exemplary embodiment or combinations thereof are not necessarily essential for the present disclosure.

In the present specification, "a state in which member A is connected with member B" includes a case where the members A and B are indirectly connected with each other without substantially affecting the electrical connecting state therebetween, a case where the members A and B are indirectly connected with each other without impairing a function or effect to be exhibited by a combination of these members, and a case where the members A and B are indirectly connected with each other via other members, in addition to a case where the members A and B are physically directly connected with each other.

Similarly, "a state in which member C is installed between member A and member B" includes a case where the members C and A or the members C and B are indirectly connected with each other without substantially affecting the electrical connecting state therebetween, a case where the members C and A or the members C and B are indirectly connected with each other without impairing a function or effect to be exhibited by a combination of these members, and a case where the members C and A or the members C and B are indirectly connected with each other via other members, in addition to a case where the members A and C or the members B and C are directly connected with each other.

Also, in the present specification, symbols denoted for electrical signals such as voltage signals and current signals, or circuit elements such as resistors and capacitors may indicate a voltage value, a current value, a resistor value, or a capacity value of each of them.

Figure 2:
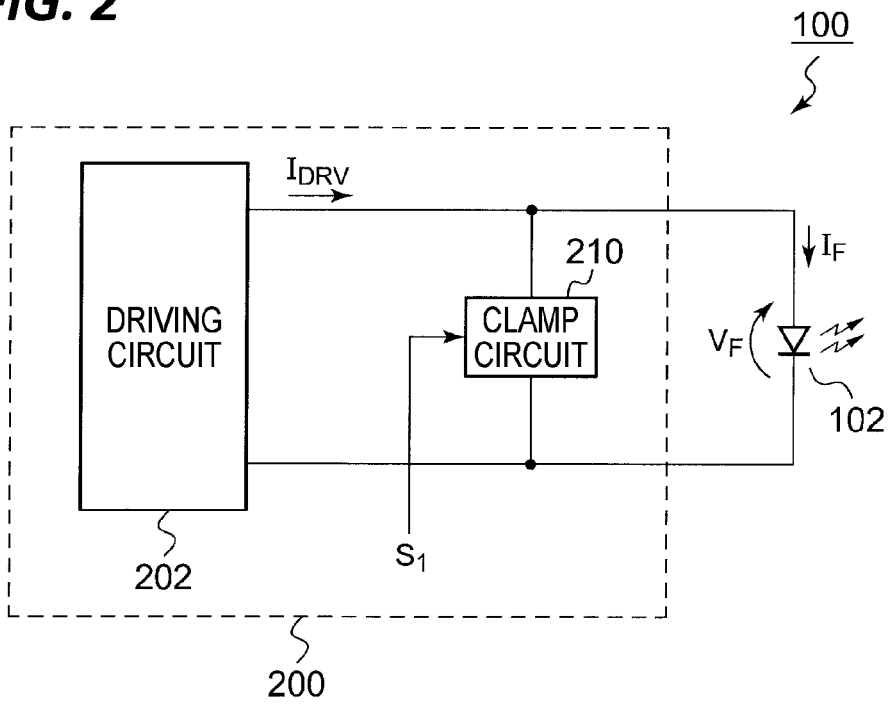
FIG. 2 is a block diagram of an illumination device including a lighting circuit according to an exemplary embodiment.

FIG. 2 is a block diagram of an illumination device 100 including a lighting circuit 200 according to an exemplary embodiment. The illumination device 100 includes a light source 102 and a lighting circuit 200. The light source 102 is a semiconductor light source such as an LED, an LD, or an organic EL, and emits light with a luminance corresponding to a supplied driving current (a forward current) $I_F$. Further, the light source 102 may be an LED bar including a plurality of LEDs connected in series. The lighting circuit 200 generates a driving current $I_{DRV}$ stabilized to a constant current (target current), supplies the driving current $I_{DRV}$ to the light source 102 in a period in which the light source 102 is to be turned on, and suppresses the current flowing to the light source 102 to be equal to or less than a lighting threshold value in a period in which the light source 102 is to be turned off.

The lighting circuit 200 includes a driving circuit 202 and a clamp circuit 210. The clamp circuit 210 clamps the voltage $V_F$ between both ends of the light source 102 in a period in which the light source 102 is to be turned off. The clamp level $V_{CL}$ is defined to be higher than zero and lower than the threshold voltage $V_{TH}$ of the light source 102 when the light source 102 is turned on/off. More specifically, the clamp circuit 210 is configured such that enabling (activating) and disabling (deactivating) may be switched in response to a control signal $S_1$ that instructs the light source 102 to be turned on/off. The control signal $S_1$ may be generated inside the lighting circuit 200, or may be provided from the outside.

When the control signal $S_1$ is at a first level (lighting level), the clamp circuit 210 becomes disabled and is in a state where the light source 102 and the driving circuit 202 are not electrically operated. In the disabled state, the clamp circuit 210 may be in a high impedance state.

When the control signal $S_1$ is at a second level (extinguishing level), the clamp circuit 210 becomes an enabled state and clamps the voltage $V_F$ between both ends of the light source 102 to the clamp level $V_{CL}$. This is called a first function.

Figure 3:
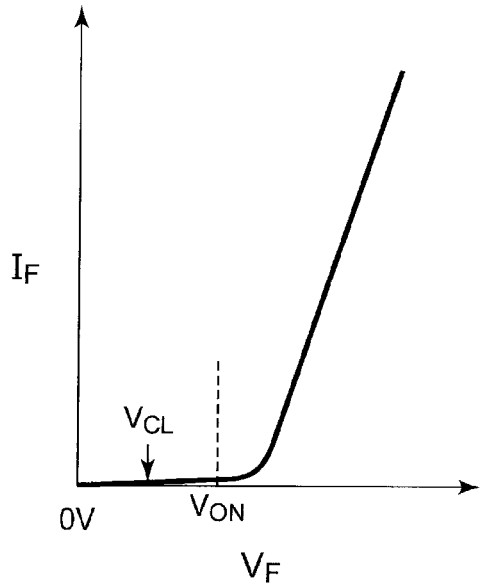
FIG. 3 is a view illustrating I/V characteristics of a light source.

FIG. 3 is a view illustrating I/V characteristics of the light source 102. The horizontal axis represents the voltage between both ends of the light source 102, that is, a forward voltage $V_F$, and the vertical axis represents a forward current $I_F$. In a case where the light source 102 is an LED, it may be assumed that in a region where the forward voltage $V_F$ is lower than an on-voltage $V_{ON}$, the forward current $I_F$ is substantially zero, and the light source 102 is turned off. In a region where the forward voltage $V_F$ is higher than the on-voltage $V_{ON}$, the forward current $I_F$ increases according to the forward voltage $V_F$, and the light source 102 emits light with a luminance according to the forward current $I_F$. Thus, when the light source 102 is an LED, the threshold voltage $V_{TH}$ may be associated with the on-voltage $V_{ON}$.

Further, the threshold voltage $V_{TH}$ is a boundary between the on state and the off state of the light source 102, and the off state does not require that photons emitted from the light source 102 are completely zero. For example, when the amount of light from the light source 102 is subjected to a multi-level control, a state in which the amount of emitted photons is sufficiently smaller than a light amount corresponding to 1 LSB may be regarded as an off state. Alternatively, a state in which the amount of emitted photons is less than the light amount that may be perceived by humans may be regarded as an off state.

In FIG. 3, when $V_{ON}$ is equal to $V_{TH}$, the clamp level $V_{CL}$ is set between 0 V and the on-voltage $V_{ON}$.

Figure 4:
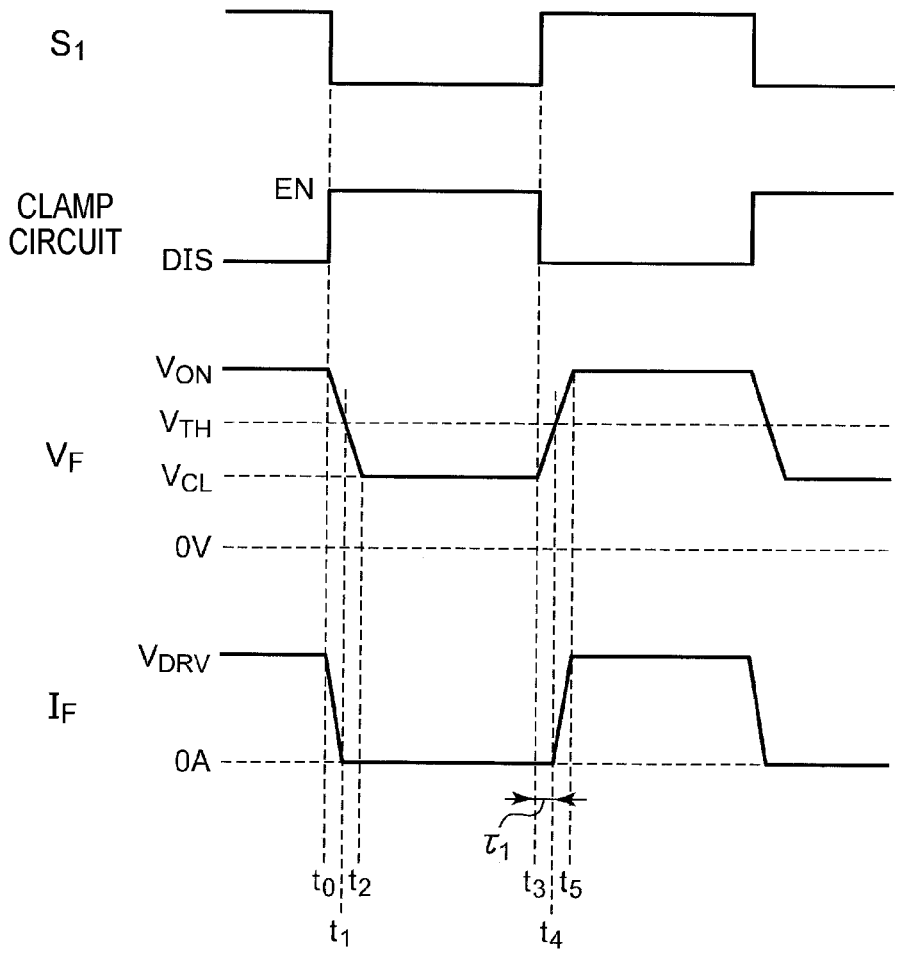
FIG. 4 is an operation waveform diagram of the lighting circuit of FIG. 2.

A configuration of the lighting circuit 200 has been described above. Next, an operation of the lighting circuit 200 will be described. FIG. 4 is an operation waveform diagram of the lighting circuit 200 of FIG. 2. Before time $t_0$, a control signal $S_1$ is at a lighting level (high level), and the clamp circuit 210 is in a disabled state (DIS). At this time, the forward current $I_F$ of the light source 102 becomes equal to the driving current $I_{DRV}$ generated by the driving circuit 202, and the light source 102 emits light having a luminance according to the driving current $I_{DRV}$. The forward voltage $V_F$ is the voltage level $V_{ON}$ corresponding to the driving current $I_{DRV}$.

When the control signal $S_1$ shifts to the extinguishing level (low level) at time $t_0$, the clamp circuit 210 becomes the enabled state (EN). When the clamp circuit 210 becomes the enabled state, the voltage between both ends of the light source 102 (forward voltage) $V_F$ is clamped to the clamp level $V_{CL}$. The forward voltage $V_F$ decreases toward the clamp level $V_{CL}$ at a predetermined slope by the operation delay of the clamp circuit 210, and the forward current $I_F$ of the light source, that is, the luminance, also decreases with time. It is to be noted that the difference between the driving current $I_{DRV}$ generated by the light source 102 and the forward current $I_F$ flows in the clamp circuit 210.

When the forward voltage $V_F$ crosses the threshold voltage $V_{TH}$ at time $t_1$, the forward current $I_F$ becomes zero and the light source 102 is turned off. Thereafter, the forward voltage $V_F$ reaches the clamp level $V_{CL}$ at time $t_2$, and then the same voltage level is maintained.

When the control signal $S_1$ shifts to the lighting level (high level) at time $t_3$, the clamp circuit 210 becomes the disabled state (DIS). When the clamp circuit 210 becomes the disabled state, the clamp of the forward voltage $V_F$ of the light source 102 is released, the driving current $I_{DRV}$ flowing in the clamp circuit 210 in the extinguishing period flows to the light source 102, and the forward voltage $V_F$ increases toward the original voltage level $V_{ON}$. Between time $t_3$ and time $t_4$ when a relation of $V_{CL}<V_F<V_{TH}$ is satisfied, the forward current $I_F$ is substantially zero, and the light source 102 is turned off.

After time $t_4$ at which the forward voltage $V_F$ crosses the threshold voltage $V_{TH}$, the forward current $I_F$ starts to flow and the luminance of the light source 102 increases. At time $t_5$, all of the driving current $I_{DRV}$ flows to the light source 102, and the forward current $I_F$ becomes equal to the driving current $I_{DRV}$.

Figure 5:
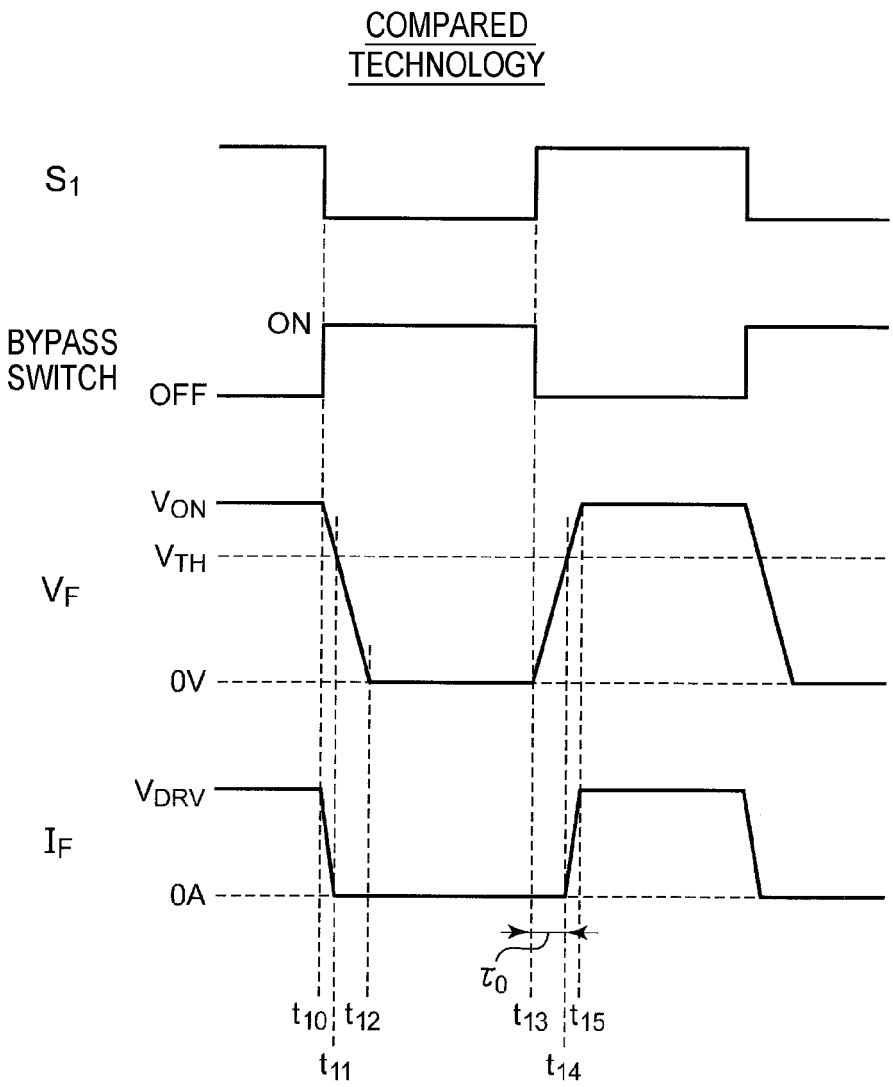
FIG. 5 is an operation waveform diagram of the lighting circuit of FIG. 1.

A configuration of a lighting circuit 200 has been described above. The advantage of the lighting circuit 200 is clarified when compared to the lighting circuit 1100 of FIG. 1. FIG. 5 is an operation waveform diagram of the lighting circuit 1100 of FIG. 1.

Before time $t_{10}$, the control signal $S_1$ is at a lighting level (high level) and a bypass switch 1104 is turned off. The driving current $I_{DRV}$ generated by the driving circuit 202 flows to a light source 1002, and the light source 1002 emits light with a luminance according to the driving current $I_{DRV}$. The forward voltage $V_F$ is the voltage level $V_{ON}$ corresponding to the driving current $I_{DRV}$.

When the control signal $S_1$ shifts to the extinguishing level (low level) at time $t_{10}$, the bypass switch 1104 is turned on. As a result, the driving current $I_{DRV}$ which flows to the light source 1002 at that time flows to the bypass switch 1104, and the forward current $I_F$ decreases.

When the forward voltage $V_F$ crosses the threshold voltage $V_{TH}$ at time $t_{11}$, the forward current $I_F$ becomes zero and the light source 1002 is turned off. Thereafter, the forward voltage $V_F$ is lowered to zero (0 V) at time $t_{12}$.

When the control signal $S_1$ shifts to the lighting level (high level) at time $t_{13}$, the bypass switch 1104 is turned off. The driving current $I_{DRV}$ flowing to the bypass switch 1104 in the extinguishing period flows to the light source 1102, and the forward voltage $V_F$ increases toward the original voltage level $V_{ON}$. Between time $t_{13}$ and time $t_{14}$ when a relation of $0<V_F<V_{TH}$ is satisfied, the forward current $I_F$ is substantially zero, and the light source 1002 is turned off.

After time $t_{14}$ when the forward voltage $V_F$ crosses the threshold voltage $V_{TH}$, the forward current $I_F$ starts to flow and the luminance of the light source 1002 increases. In addition, at time $t_{15}$, all of the driving current $I_{DRV}$ flow to the light source 1002, and the forward current $I_F$ becomes equal to the driving current $I_{DRV}$.

Figure 1:
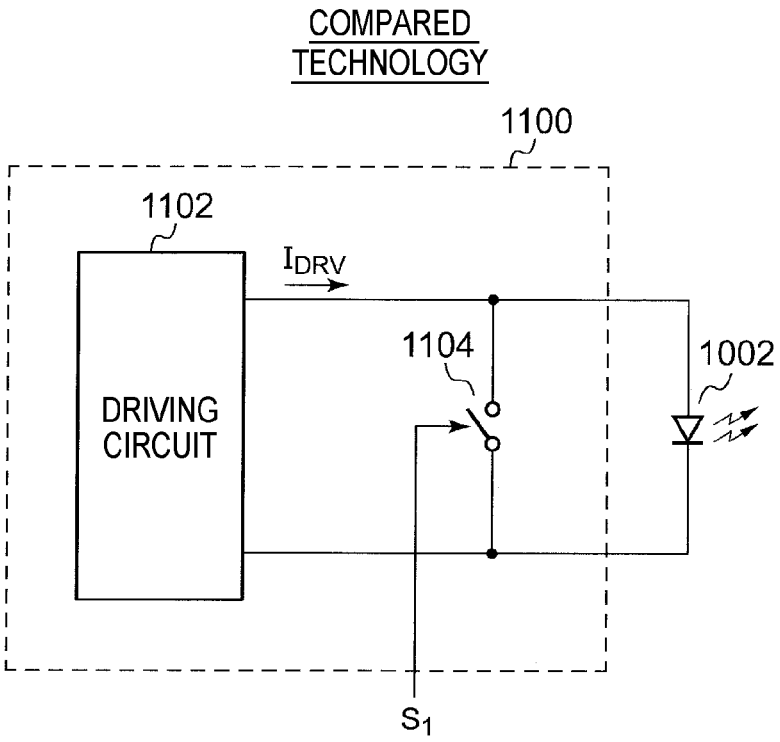
FIG. 1 is a circuit diagram of a lighting circuit in the related art.

A configuration of a lighting circuit 1100 of FIG. 1 has been described above. In the lighting circuit 1100 of FIG. 1, in a period $\tau_0$ from time $t_{13}$ at which the control signal $S_1$ has shifted to the lighting level to time $t_{14}$ at which the forward voltage $V_F$ reaches the threshold voltage $V_{TH}$ (referred to as a lighting disable period), the forward current $I_F$ is zero and the light source 1002 is not able to be turned on.

As the period of the control signal $S_1$ (switching period $T_P$) becomes shorter, in other words, as the switching frequency becomes higher, the ratio occupied by the lighting disable period $\tau_0$ in the period $T_P$ becomes higher. In other words, the switching period $T_P$ is constrained by the lighting disable period $\tau_0$.

Further, the length of the lighting disable period $\tau_0$ in FIG. 5 may be approximated to $\tau_0=V_{TH}/SR_0$ by using the rising speed of the forward voltage $V_F$ (slew rate $SR_0$).

Return to FIG. 4. In FIG. 4, the period between time $t_3$ and time $t_4$ corresponds to the lighting disable period $\tau_1$. The length of the lighting disable period $\tau_1$ may be approximated to $\tau_1=(V_{TH}-V_{CL})/SR_1$ by using the rising speed of the forward voltage $V_F$ (slew rate $SR_1$). Assuming that the slew rates of FIGS. 4 and 5 are the same ($SR_0=SR_1$), the lighting disable period $\tau_1$ of FIG. 4 becomes shorter than the lighting disable period $\tau_0$ of FIG. 5.

Thus, according to the lighting circuit 200 of FIG. 2, since the lighting disable period $\tau$ in which the light source 102 is switched from off to on may be shortened, high-speed switching becomes possible.

In addition, since the load fluctuation when viewed from the driving circuit 202 may be reduced, the design restriction of the driving circuit 202 may be alleviated, thereby facilitating the design of the driving circuit 202.

For example, the driving circuit 202 may be configured with a switching converter (switch mode power supply) the output current of which is subjected to a constant current control. A switching converter that outputs a constant current is required to have a function of maintaining the output current regardless of a variation in the output voltage. In an application where the output voltage changes at high speed and large amplitude, a response speed required for the switching converter becomes very fast, which makes the design very difficult. The first function of the clamp circuit 210 has an advantage in that the fluctuation range of the output voltage becomes smaller, so that the design of the switching converter is facilitated. The driving circuit 202 may be configured with a linear power supply, but the same advantage may be obtained even in this case.

The lighting disable period $\tau_1$ becomes shorter as the variation width $\Delta V$ ($=V_{TH}-V_{CL}$) of the forward voltage $V_F$ in the extinguishing period and the lighting period is reduced. Thus, in order to increase the switching frequency, the clamp level $V_{TH}$ may be set to be as high as possible in a range not exceeding the threshold voltage $V_{TH}$. From this point of view, the clamp level $V_{CL}$ may be higher than ⅓ of the threshold voltage $V_{TH}$ and higher than ½ of the threshold voltage $V_{TH}$.

In the meantime, when the clamp level $V_{CL}$ is increased too much, the light source 102 may be erroneously turned on in the extinguishing period due to unevenness in the threshold voltage $V_{TH}$ or temperature fluctuation. From this point of view, the clamp level $V_{CL}$ may be lower than ⅘ of the threshold voltage $V_{TH}$ and lower than ¾ of the threshold voltage $V_{TH}$.

Subsequently, a more preferable function (second function) of the clamp circuit 210 will be described. The clamp circuit 210 immediately reduces the voltage $V_F$ between both ends of the light source 102 to substantially zero in response to the extinguishing instruction of the light source 102 (i.e., a negative edge of the control signal $S_1$). The clamp circuit 210 then clamps the voltage $V_F$ between both ends of the light source 102 to the clamp level $V_{CL}$ before the light source 102 is turned on (first function).

Figure 6:
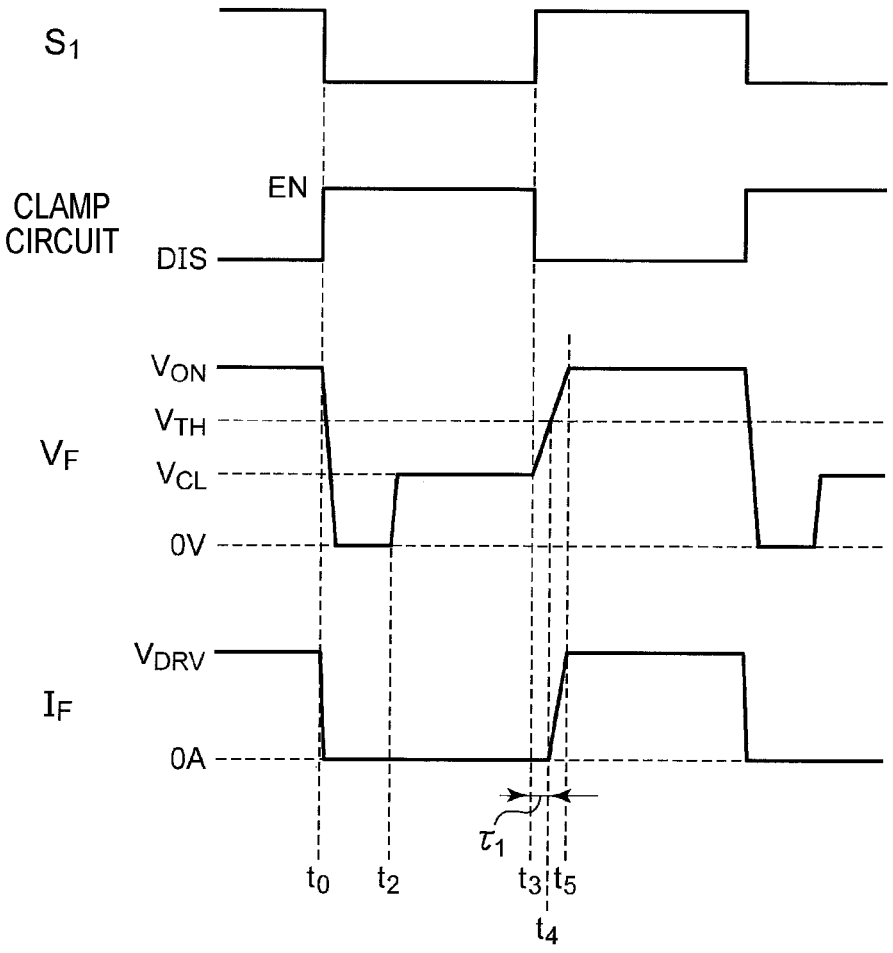
FIG. 6 is an operation waveform diagram of the lighting circuit including a second function.

FIG. 6 is an operation waveform diagram of the lighting circuit including a second function. When the control signal $S_1$ is switched to the extinguishing level at time $t_0$, the voltage $V_F$ between the both ends of the light source 102 is lowered to zero (0 V). As a result, the forward current $I_F$ is immediately lowered to zero.

Thereafter, the voltage $V_F$ between the both ends of the light source 102 is returned to the clamp level $V_{CL}$ at time $t_2$ preceding time $t_3$ at which the control signal $S_1$ is switched to the lighting level.

Thus, according to the clamp circuit 210 including the second function, the light source 102 may be turned off at high speed.

The present disclosure is not limited to a specific configuration, which is applied to various devices and circuits that are understood as a block diagram or a circuit diagram of FIG. 2 or derived from the above description. Hereinafter, in order to facilitate understanding of the nature of the present disclosure and the circuit operation, and to clarify these, rather than narrowing the scope of the present disclosure, a more specific configuration example or modification example will be described.

First Configuration Example

Figure 7:
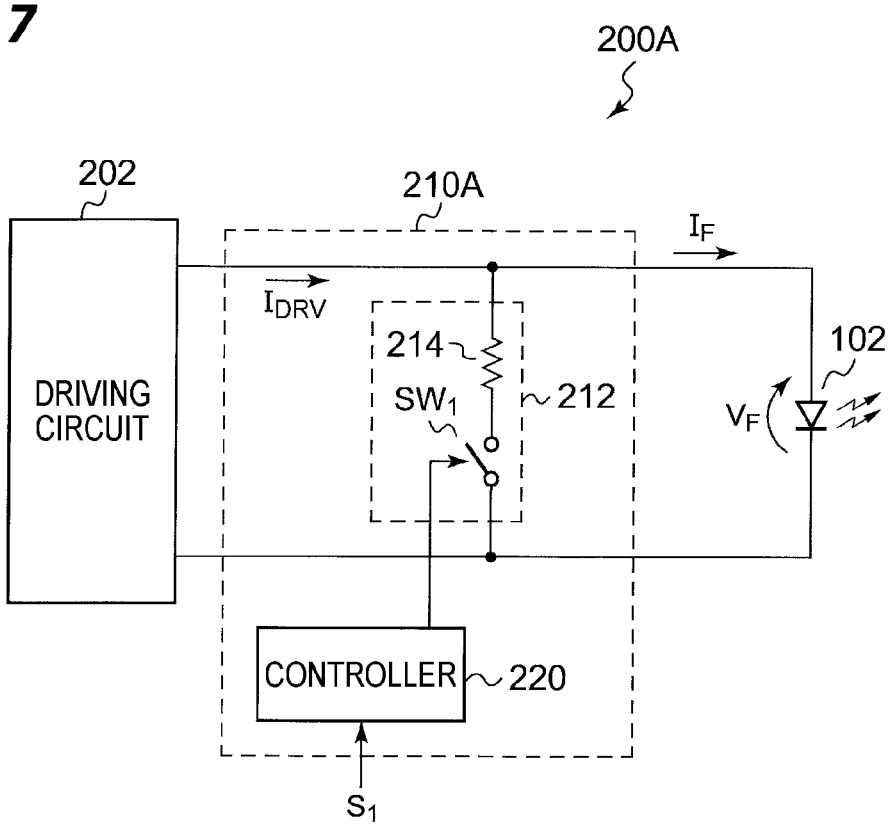
FIG. 7 is a circuit diagram of a first configuration example of the lighting circuit of FIG. 2.

FIG. 7 is a circuit diagram of a first configuration example 200A of a lighting circuit 200 of FIG. 2. A clamp circuit 210A includes the above-described first function. The clamp circuit 210A includes a first switch $SW_1$ and a clamp resistor 214 provided in series on a first path 212 that is in parallel with the light source 102. The on state of the first switch $SW_1$ corresponds to the enabled state of the clamp circuit 210A, and the off state of the first switch $SW_1$ corresponds to the disabled state of the clamp circuit 210A.

When the resistance value of the first path 212 is $R_1$ and the driving current generated by the driving current 202 is $I_{DRV}$, the voltage between both ends of the first path 212 becomes $R_1 \times I_{DRV}$ in an enabled state. In other words, the clamp level $V_{CL}$ is given by the following equation.

$$V_{CL}=R_1 \times I_{DRV}$$

Therefore, a relation of $0<R_1 \times I_{DRV}<V_{TH}$ may be satisfied.

The resistance value $R_1$ of the first path 212 is the sum of the resistance value of the clamp resistor 214 and the resistance value of the first switch $SW_1$.

The clamp circuit 210A may further include a controller 220. The controller 220 controls the on/off of the first switch $SW_1$ based on the control signal $S_1$. Specifically, the controller 220 turns off the first switch $SW_1$ when the control signal $S_1$ is at a lighting level, and turns on the first switch $SW_1$ when the control signal $S_1$ is at an extinguishing level.

According to the lighting circuit 200A of FIG. 7, the operation of FIG. 4 may be implemented.

Second Configuration Example

Figure 8:
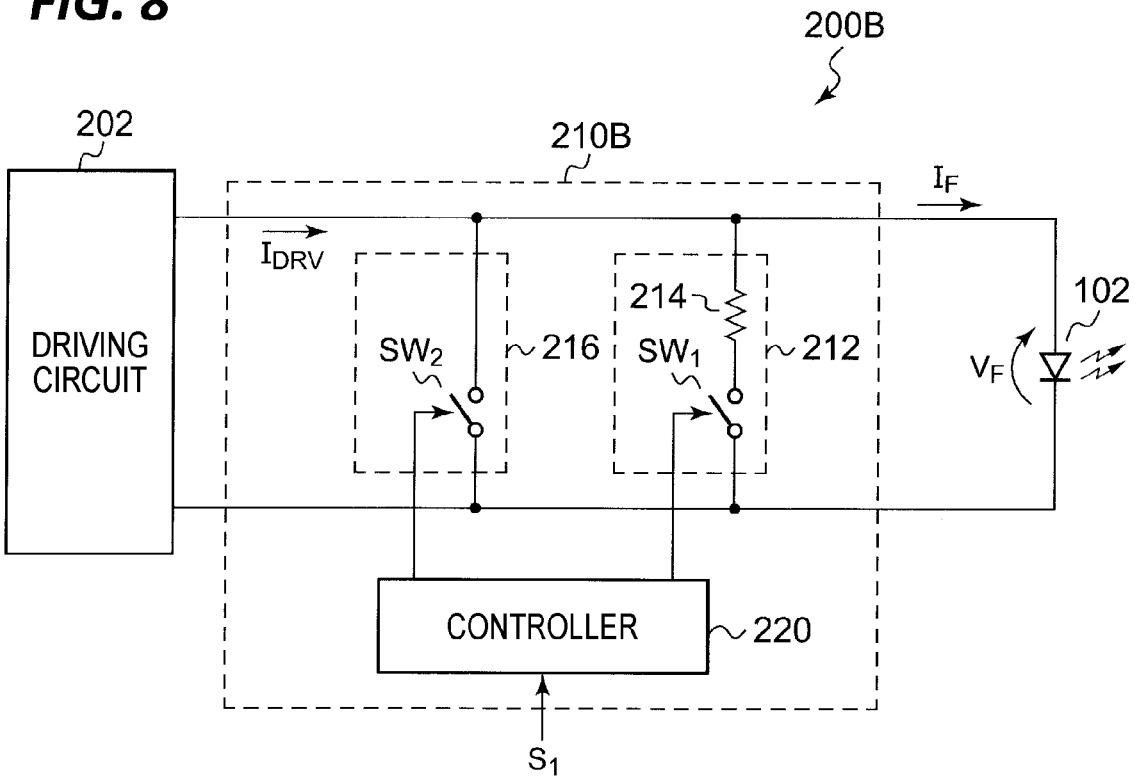
FIG. 8 is a circuit diagram of a second configuration example of the lighting circuit of FIG. 2.

FIG. 8 is a circuit diagram of a second configuration example 200B of the lighting circuit 200 of FIG. 2. A clamp circuit 210B includes the above-described first function and second function. The clamp circuit 210B further includes a second switch $SW_2$ provided on the second path 216 that is in parallel with the light source 102, in addition to the clamp circuit 210A of FIG. 7.

The controller 220 turns on the first switch $SW_1$ in the extinguishing period of the light source 102 (the control signal $S_1$ is at the extinguishing level), and turns off the first switch $SW_1$ in the lighting period of the light source 102 (the control signal S is at the lighting level). Further, the controller 220 turns on the second switch $SW_2$ immediately after the extinguishing instruction of the light source 102

(i.e., an edge corresponding to the control signal $S_1$) is triggered, and then turns off the second switch $SW_2$ before the lighting instruction of the light source 102. For example, when the lighting level is high, the controller 220 may turn on the second switch $SW_2$ for a very short time with the negative edge of the control signal $S_1$ as a trigger. Alternatively, the controller 220 may turn on the second switch $SW_2$ for a predetermined period of time from the negative edge of the control signal $S_1$.

According to the lighting circuit 200B of FIG. 8, the operation of FIG. 5 may be implemented.

Figure 9A:
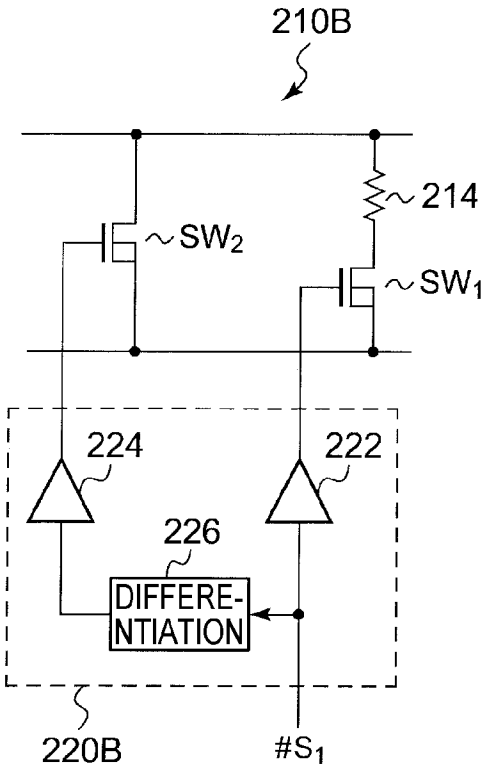
FIGS. 9A and 9B are circuit diagrams illustrating a specific configuration example of a clamp circuit of FIG. 8.
Figure 9B:
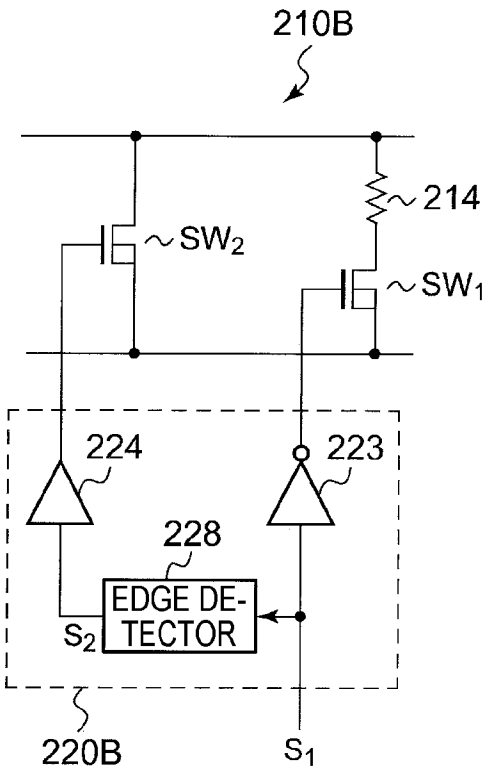

FIGS. 9A and 9B are circuit diagrams illustrating a specific configuration example of a clamp circuit 210B of FIG. 8. Each of the first switch $SW_1$ and the second switch $SW_2$ is an N-channel metal oxide semiconductor field effect transistor (MOSFET). Further, the first switch $SW_1$ and the second switch $SW_2$ may be configured with a bipolar transistor or an insulated gate bipolar transistor (IGBT).

Reference is made to FIG. 9A. $\#S_1$ is an inverted signal of the control signal $S_1$ in which the extinguishing level is high and the lighting level is low. A first driver 222 drives the first switch $SW_1$ based on the control signal $\#S_1$. A differentiator 226 differentiates the control signal $S_1$. For example, the differentiator 226 may be configured with a high pass filter, and, for example, may include a capacitor provided on a signal path. The output of the differentiator 226 is increased by the positive edge of the control signal $\#S_1$ and immediately returns to zero. A second driver 224 drives the second switch $SW_2$ based on the output of the differentiator 226.

In FIG. 9A, the differentiator 226 and the second driver 224 may be replaced with each other. Further, in FIG. 9A, the second driver 224 may be omitted, the output of the first driver 22 may be directly supplied to a gate of the first switch $SW_1$, and the output of the first driver 222 may be supplied to a gate of the second switch $SW_2$ via the differentiator 226.

Reference is made to FIG. 9B. The first driver 223 drives the first switch $SW_1$ based on the control signal $S_1$. An edge detector 228 detects an edge corresponding to the extinguishing instruction of the control signal $S_1$ (a positive edge when the extinguishing level is low), and generates an edge detection signal $S_2$ that is at a high level for a predetermined time from the detected edge. The second driver 224 drives the second switch $SW_2$ based on the edge detection signal $S_2$.

FIGS. 10A to 10E are circuit diagrams illustrating modifications of the clamp circuit 210. Here, only a portion related to the first function is illustrated. In the clamp circuit 210 of FIG. 10A, the clamp resistor is omitted and a MOSFET having a large on-resistance $R_{ON}$ corresponding to the resistance of the clamp resistor may be used as the first switch $SW_1$. That is, the on-resistance $R_{ON}$ becomes the resistance value $R_1$ of the first path 212, and a numerical value obtained by a relation of $R_{ON} \times I_{DRV}$ becomes the clamp level $V_{CL}$.

Figure 10A:
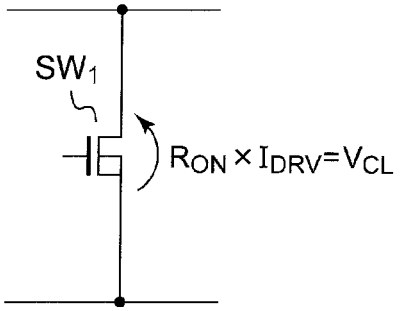
FIGS. 10A to 10E are circuit diagrams illustrating modifications of the clamp circuit.
Figure 10B:
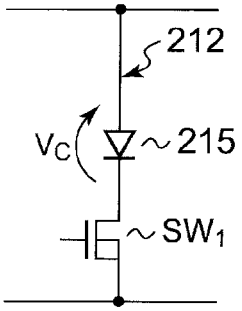

In the clamp circuit 210 of FIG. 10B, a diode 215 and a first switch $SW_1$ are provided in series on the first path 212. The driving current $I_{DRV}$ flows through the diode 215 to generate a substantially constant forward voltage $V_c$. When the on-resistance of the first switch $SW_1$ is sufficiently small, $V_{CL}$ becomes equal to $V_C$. When the on-resistance of the first switch $SW_1$ is sufficiently large, a relation of $V_{CL}=V_C+I_{DRV} \times R_{ON}$ is satisfied.

Figure 10C:
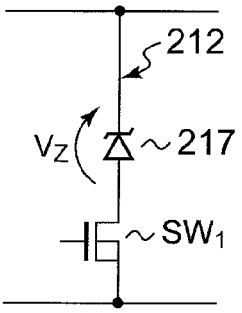

In the clamp circuit 210 of FIG. 10C, a Zener diode 217 and a first switch $SW_1$ are provided in series on the first path 212. The driving current $I_{DRV}$ flows through the Zener diode 217 to generate a substantially constant Zener voltage $V_Z$. When the on-resistance of the first switch $SW_1$ is sufficiently small, $V_{CL}$ becomes equal to $V_Z$. When the on-resistance of the first switch $SW_1$ is large, a relation of $V_{CL}=V_Z I_{DVR} \times R_{ON}$ is satisfied.

Figure 10D:
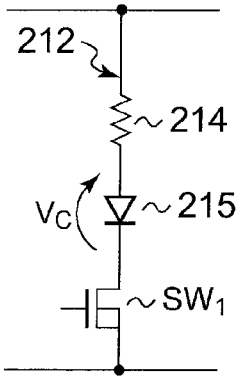
Figure 10E:
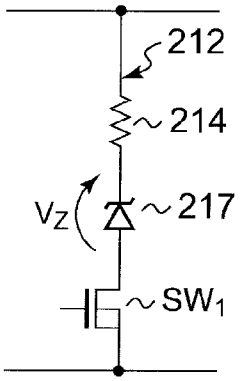

In the clamp circuit 210 of FIG. 10D, when the resistance value of the clamp resistor 214 is $R_1$, a relation of $V_{CL}=V_C+(R_1+R_{ON}) \times I_{DRV}$ is satisfied. In the clamp circuit 210 of FIG. 10E, when the resistance value of the clamp resistor 214 is $R_1$, a relation of $V_{CL}=V_Z+(R_1+R_{ON}) \times I_{DRV}$ is satisfied.

In sum, the clamp circuit 210 may be configured with any combination of a resistor, a diode, and a Zener diode.

Third Configuration Example

Figure 11:
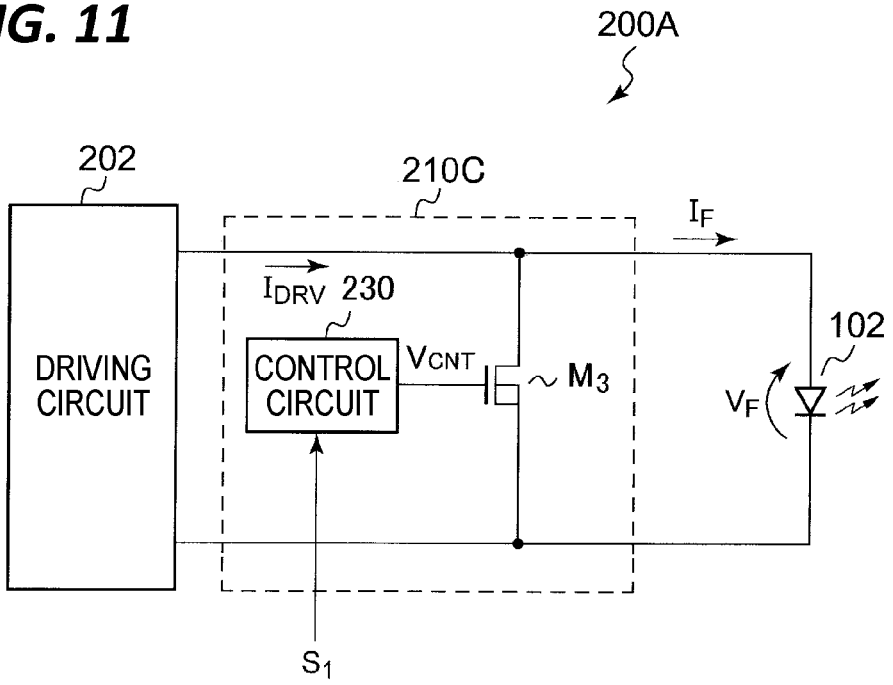
FIG. 11 is a circuit diagram of a third configuration example of the lighting circuit of FIG. 2.

FIG. 11 is a circuit diagram of a third configuration example 200C of the lighting circuit 200 of FIG. 2. The clamp circuit 210C includes the above-described first function and second function. The clamp circuit 210C includes a shaft transistor $M_3$ provided on the first path 212 in parallel with the light source 102, and a transistor control circuit 230. The transistor control circuit 230 sets the voltage (gate voltage, base voltage) $V_{CNT}$ of the control terminal of the shaft transistor $M_3$ so that the voltage between both ends of the light source 102 becomes a clamp level defined to be lower than the threshold voltage $V_{TH}$ when the light source is turned on/off, when the control signal $S_1$ is at the extinguishing level, that is, in the enabled state of the clamp circuit 210C. The shaft transistor $M_3$ may be a MOSFET, a bipolar transistor, or an IGBT. The transistor control circuit 230 turns off the shaft transistor $M_3$ when the control signal $S_1$ is at the lighting level, that is, in the disabled state of the clamp circuit 210C.

Figure 12:
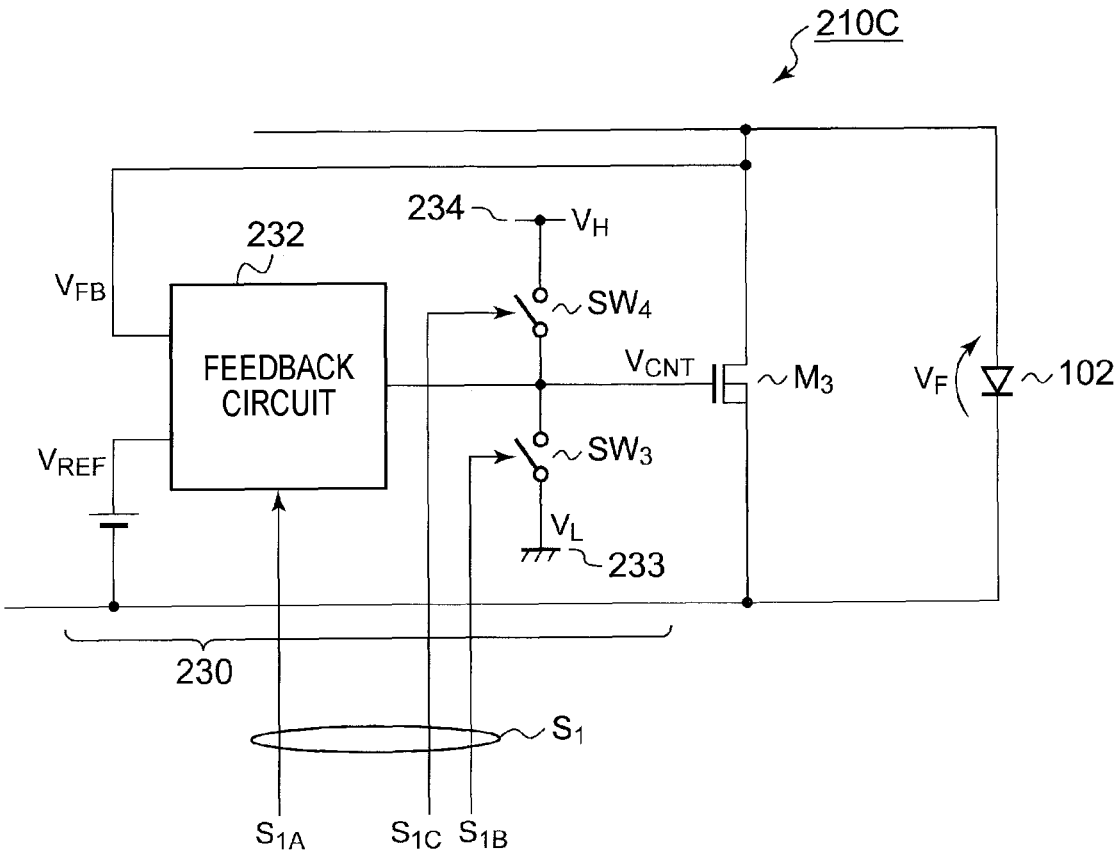
FIG. 12 is a circuit diagram illustrating a first configuration example of a clamp circuit of FIG. 11.

FIG. 12 is a circuit diagram illustrating a first configuration example of the clamp circuit 210C of FIG. 11. The transistor control circuit 230 of FIG. 12 includes a feedback circuit 232, a third switch $SW_3$, and a fourth switch $SW_4$.

The feedback circuit 232 receives a target voltage $V_{REF}$ of the clamp level and a feedback voltage $V_{FB}$ representing a voltage between both ends of the shaft transistor $M_3$, and brings the voltage $V_F$ between both ends of the light source 102 closer to the clamp level $V_{CL}$ by feedback. The configuration of the feedback circuit 232 is not limited thereto, but may be configured with an analog error amplifier or may be configured with a digital feedback circuit (a PI controller or a PID controller) and an A/D converter. The feedback circuit 232 and the shaft transistor $M_3$ may be understood as a shaft regulator.

Figure 14:
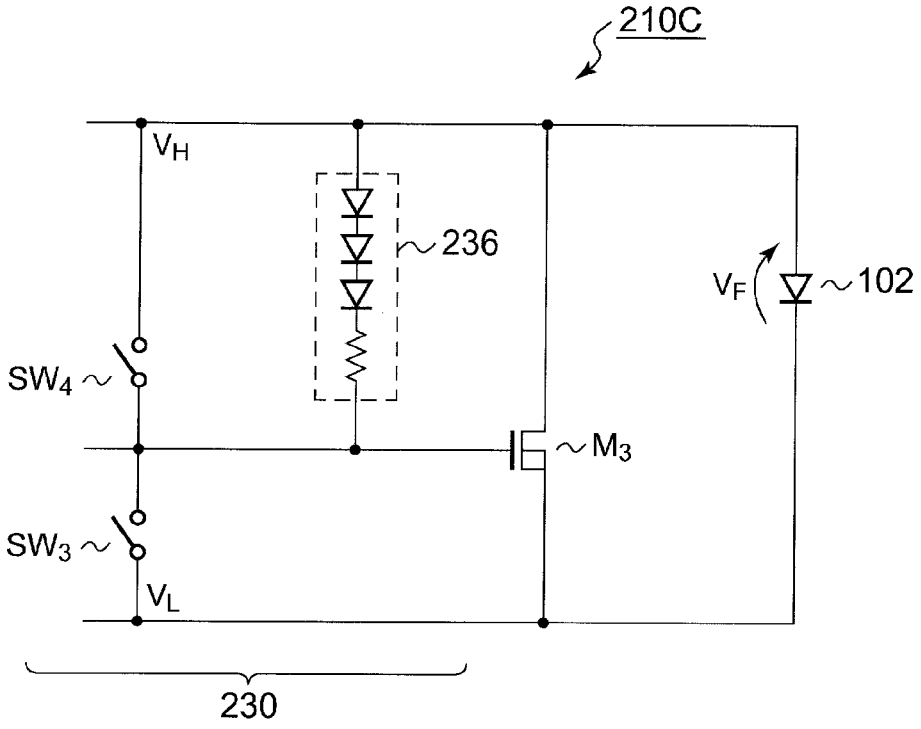
FIG. 14 is a circuit diagram illustrating a second configuration example of the clamp circuit of FIG. 11.

The third switch $SW_3$ is provided between the control terminal (gate) of the shaft transistor $M_3$ and a low voltage terminal 233 to which a predetermined low voltage $V_L$ is supplied. Further, the third switch $SW_3$ may be provided between the control terminal (gate) of the shaft transistor $M_3$ and a low potential side end (cathode) of the light source 102, as illustrated in FIG. 14.

The fourth switch $SW_4$ is provided between the control terminal (gate) of the shaft transistor $M_3$ and a high voltage terminal 234 to which a predetermined high voltage $V_H$ is supplied. Further, the fourth switch $SW_4$ may be provided between the control terminal (gate) of the shaft transistor $M_3$ and a high potential side end (anode) of the light source 102, as illustrated in FIG. 14.

The control signal $S_1$ includes a signal $S_{1A}$ instructing on/off of the feedback circuit 232, a signal $S_{1B}$ instructing on/off of the third switch $SW_3$, and a signal $S_{1C}$ instructing on/off of the fourth switch $SW_4$. The feedback circuit 232 is configured to be in the enabled state when the signal $S_{1A}$ is at a high level and in the disabled state when the signal $S_{1A}$ is at a low level.

Figure 13:
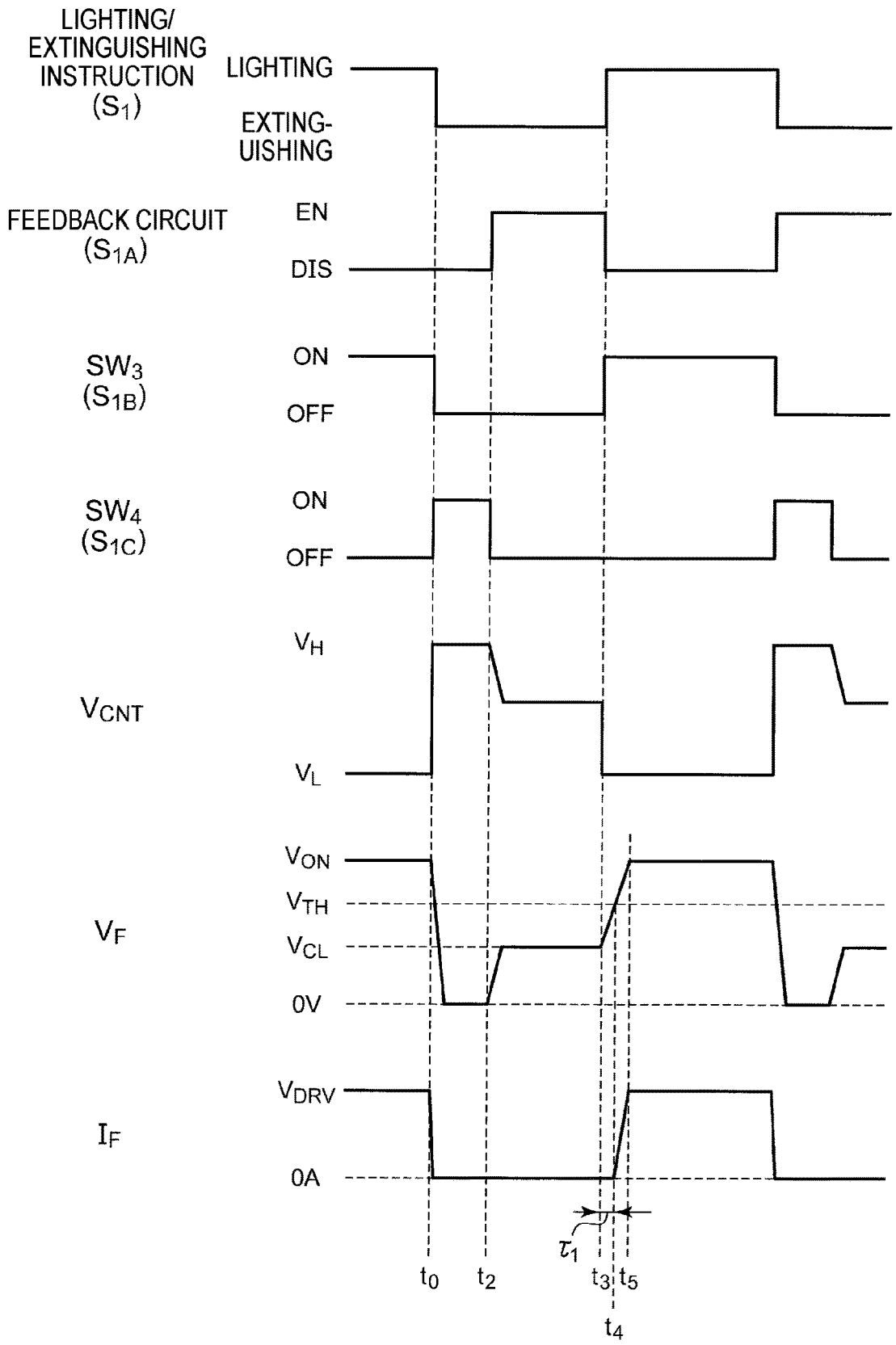
FIG. 13 is an operation waveform diagram of the clamp circuit of FIG. 12.

FIG. 13 is an operation waveform diagram of the clamp circuit 210C of FIG. 12. Before time $t_0$, the control signal $S_1$ is at a lighting level (high level). Specifically, the control signals $S_{1A}$, $S_{1B}$, and $S_{1C}$ are generated such that the feedback circuit 232 is in the disabled state, the third switch $SW_3$ is in the on state, and the fourth switch $SW_4$ is in the off state. As a result, the gate voltage $V_{CNT}$ of the shaft transistor $M_3$ becomes a low voltage $V_L$, and the shaft transistor $M_3$ is turned off. This corresponds to the disabled state (DIS) of the clamp circuit 210C. At this time, the forward current $I_F$ of the light source 102 becomes equal to the driving current $I_{DRV}$ generated by the driving circuit 202, and the light source 102 emits light with a luminance corresponding to the driving current $I_{DRV}$. The forward voltage $V_F$ is the voltage level $V_{ON}$ corresponding to the driving current $I_{DRV}$.

The control signal $S_1$ shifts to the extinguishing level (low level) at time $t_0$. The control signals $S_{1A}$, $S_{1B}$, and $S_{1C}$ are generated so that the feedback circuit 232 is in the disabled state, the third switch $SW_3$ is in the off state, and the fourth switch $SW_4$ is in the on state. As a result, the gate voltage $V_{CNT}$ of the shaft transistor $M_3$ is immediately changed to a high voltage $V_H$, and the shaft transistor $M_3$ is turned on. Therefore, the forward current $I_F$ is immediately lowered to zero and the light source 102 is turned off.

At subsequent time $t_2$, the control signals $S_{1A}$, $S_{1B}$, and $S_{1C}$ are generated so that the feedback circuit 232 is in the enabled state, the third switch $SW_3$ is in the off state, and the fourth switch $SW_4$ is in the off state. The gate voltage $V_{CNT}$ is adjusted by the feedback control of the feedback circuit 232 so that the voltage $V_F$ between both ends of the light source 102 is close to the clamp level $V_{CL}$.

The control signal $S_1$ shifts to the lighting level (high level) at time $t_3$. The control signals $S_{1A}$, $S_{1B}$, and $S_{1C}$ are generated such that the feedback circuit 232 is in the disabled state, the third switch $SW_3$ is in the on state, and the fourth switch $SW_4$ is in the off state. By turning on the third switch $SW_3$, the shaft transistor $M_3$ is turned off, the clamp of the forward voltage $V_F$ of the light source 102 is released, the driving current $I_{DRV}$ flowing through the shaft transistor $M_3$ in the extinguishing period flows to the light source 102, and the forward voltage $V_F$ increases toward the original voltage level $V_{ON}$.

After time $t_4$ when the forward voltage $V_F$ crosses the threshold voltage $V_{TH}$, the forward current IF starts to flow and the luminance of the light source 102 increases. At time $t_5$, all of the driving current $I_{DRV}$ flows to the light source 102, and the forward current $I_F$ becomes equal to the driving current $I_{DRV}$.

The operation of the clamp circuit 210C of FIG. 12 has been described above. According to the clamp circuit 210C, the above-described first function and second function may be implemented.

Further, in FIG. 12, the fourth switch $SW_4$ may be omitted when the transistor control circuit 230 may shift the output voltage $V_{CNT}$ to the high voltage $V_H$ at high speed. In addition, the third switch $SW_3$ may be omitted when the transistor control circuit 230 may shift the output voltage $V_{CNT}$ to the low voltage $V_L$ at high speed.

FIG. 14 is a circuit diagram illustrating a second configuration example of the clamp circuit 210C of FIG. 11. The clamp circuit 210C of FIG. 14 includes a constant voltage circuit 236 instead of the feedback circuit 232. The constant voltage circuit 236 is provided between the control terminal (gate) of the shaft transistor $M_3$ and the high potential side end (drain), and maintains the voltage between the gate and the drain of the shaft transistor $M_3$ at a constant level. However, since the capacity of the constant voltage circuit 236 is lower than the capacities of the third switch $SW_3$ and the fourth switch $SW_4$, and the operation of the constant voltage circuit 236 may not be seen when either the third switch $SW_3$ or the fourth switch $SW_4$ is turned on.

The configuration of the constant voltage circuit 236 is not particularly limited, but, for example, may include a plurality of (n) diodes connected in series and a resistor. In this case, the clamp level $V_{CL}$ satisfies a relation of $V_{CL}=(V_{th(gs)}+V_f \times n+V_R)$. $V_f$ is the forward voltage of the diode and $V_{th(gs)}$ is the threshold voltage between the gate and the source of the shaft transistor $M_3$.

In FIG. 14, the high voltage $V_H$ is the anode voltage of the light source 102 (the drain voltage of the shaft transistor $M_3$), and the low voltage $V_L$ is the cathode voltage of the light source 102 (the source voltage of the shaft transistor $M_3$). Further, as illustrated in FIG. 12, the high voltage $V_H$ may be an arbitrary predetermined voltage and the low voltage $V_L$ may be grounded.

Subsequently, the operation of the clamp circuit 210C of FIG. 14 will be described above. The operation waveform diagram is the same as that illustrated in FIG. 13, in which the control signal $S_{1A}$ is ignored. According to the clamp circuit 210C of FIG. 14, the same effect as the clamp circuit 210C of FIG. 12 is obtained.

Use

Subsequently, the use of a lighting circuit 200 will be described. The illumination device 100 of FIG. 2 may be used as a vehicular lamp. FIGS. 15A to 15D are views illustrating a vehicular lamp including a lighting circuit 200. A vehicular lamp 300A of FIG. 15A is a scanning lamp that scans the light emitted from the light source 302. The vehicular lamp 300A includes a lighting circuit 200, a light source 302, and a scanning device 304. The scanning device 304 includes a motor and a reflector (blade). The light emitted from the light source 302 is reflected by the blade and scanned ahead of the vehicle. An arbitrary light distribution pattern may be implemented or a road surface may be drawn by dimming the light emitted from the light source 302 in synchronization with the periodic motion of the blade or by switching the emitted light at high speed.

Figure 15B:
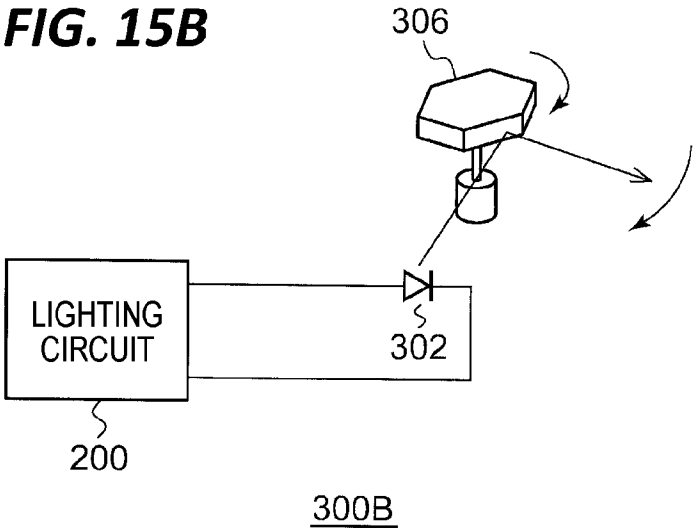
FIGS. 15A to 15D are views illustrating a vehicular lamp including a lighting circuit.
Figure 15A:
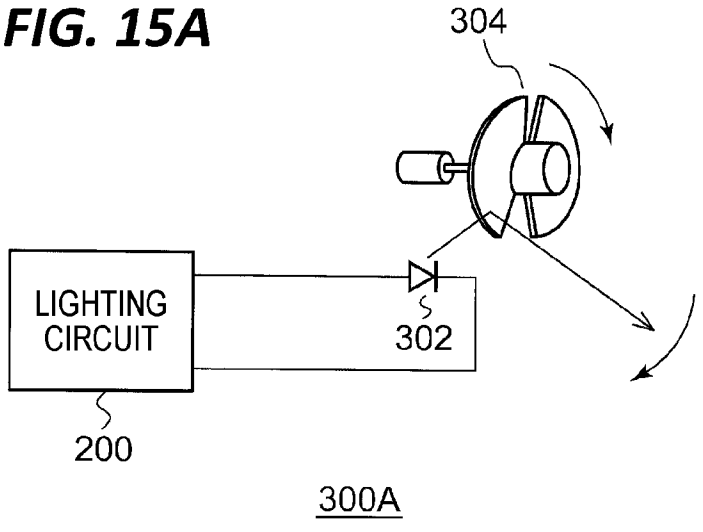

The vehicular lamp 300B of FIG. 15B is a scanning lamp that scans the light emitted from the light source 302. The vehicular lamp 300B includes the lighting circuit 200, the light source 302, and a scanning device 306. The scanning device 306 includes a motor and a galvano mirror.

Figure 15D:
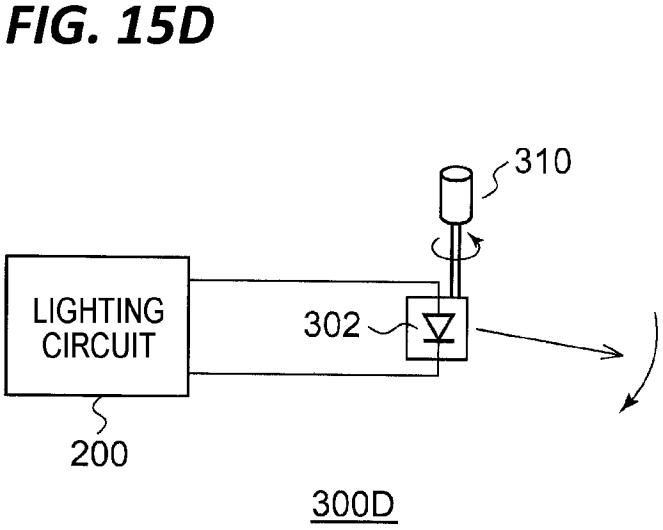
Figure 15C:
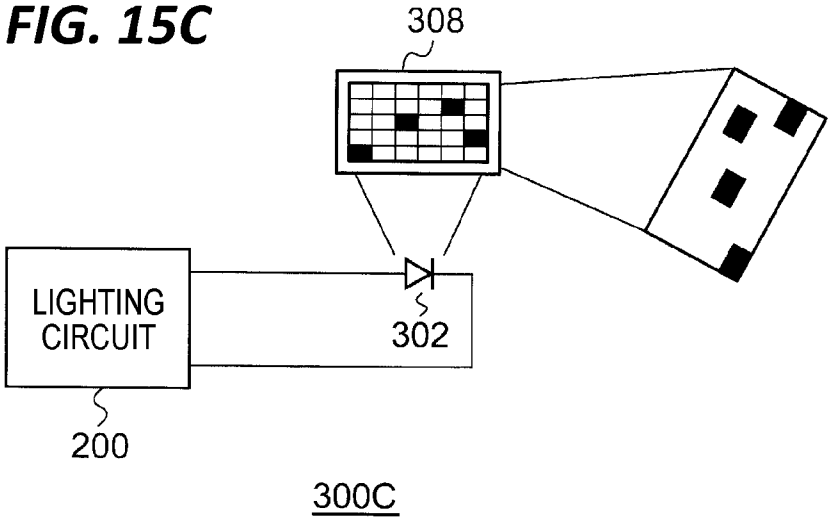

The vehicular lamp 300C of FIG. 15C includes a lighting circuit 200, a light source 302, and a pattern forming device 308. The pattern forming device 308 is a digital mirror device (DMD) including a plurality of pixels. Each pixel of the DMD may be individually turned on/off. The light emitted from the light source 302 is reflected by the pattern forming device 308, and the reflected light has a pattern corresponding to the state of the pixel of the DMD.

The vehicular lamp 300D of FIG. 15D includes a lighting circuit 200, a light source 302, and an actuator 310 that controls the direction of the light source 302. The light emitted from the light source 302 may be scanned by periodically changing the direction of the light source 302 by the actuator 302.

Figure 16B:
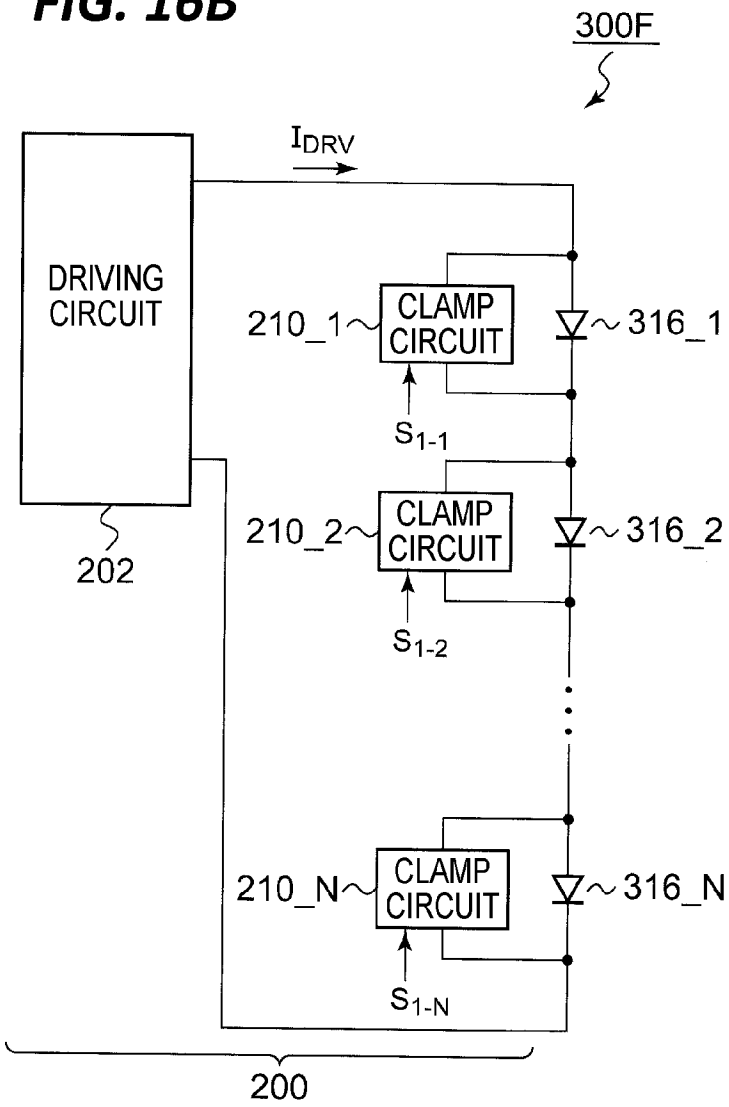
FIGS. 16A and 16B are circuit diagrams including a lighting circuit.
Figure 16A:
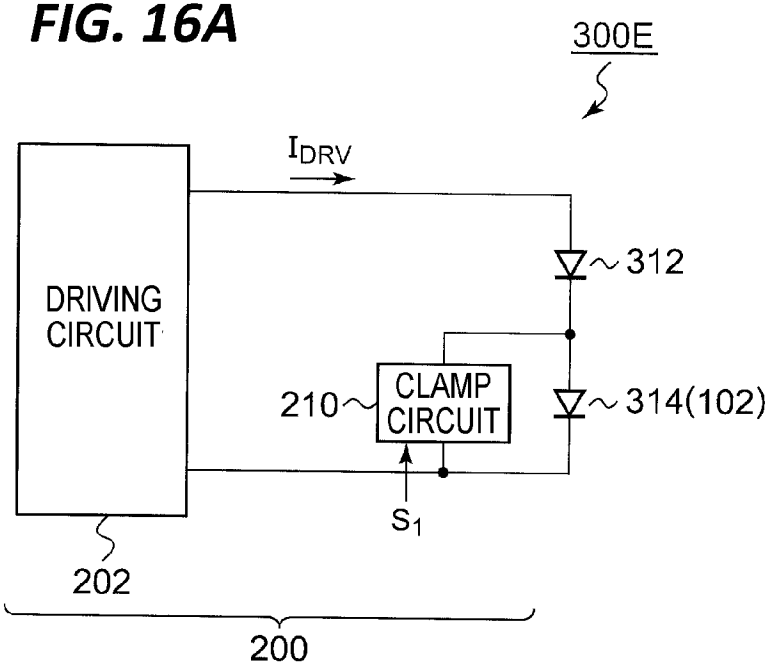

FIGS. 16A and 16B are circuit diagrams of the vehicular lamp including a lighting circuit 200. The vehicular lamp 300E of FIG. 16A includes a first light source 312, a second light source 314, and the lighting circuit 200. For example, the first light source 312 is a low beam, and the second light source 314 is a high beam. The lighting circuit 200 includes a driving circuit 202 and a clamp circuit 210. The second light source 314 corresponds to the above-described light source 102, and the clamp circuit 210 is connected to both ends of the second light source 314.

The vehicular lamp 300F of FIG. 16B includes a plurality of (N) light sources 316_1 to 316_N and a lighting circuit 200. The plurality of light sources 316 irradiate different positions in front of the vehicle. The lighting circuit 200 includes a driving circuit 202 and a plurality of clamp circuits 210_1 to 210_N. Each of the clamp circuits 210 is connected between both ends of the corresponding light source 316_*i*. A control signal $S_1$—i that instructs the lighting/extinguishing of the corresponding light source 316_*i* is input to each of the clamp circuits 210_*i*.

In the above description, the illumination device 100 having a single light source 102 has been described, but the present disclosure is also applicable to the driving of a plurality of light sources.

Figure 17:
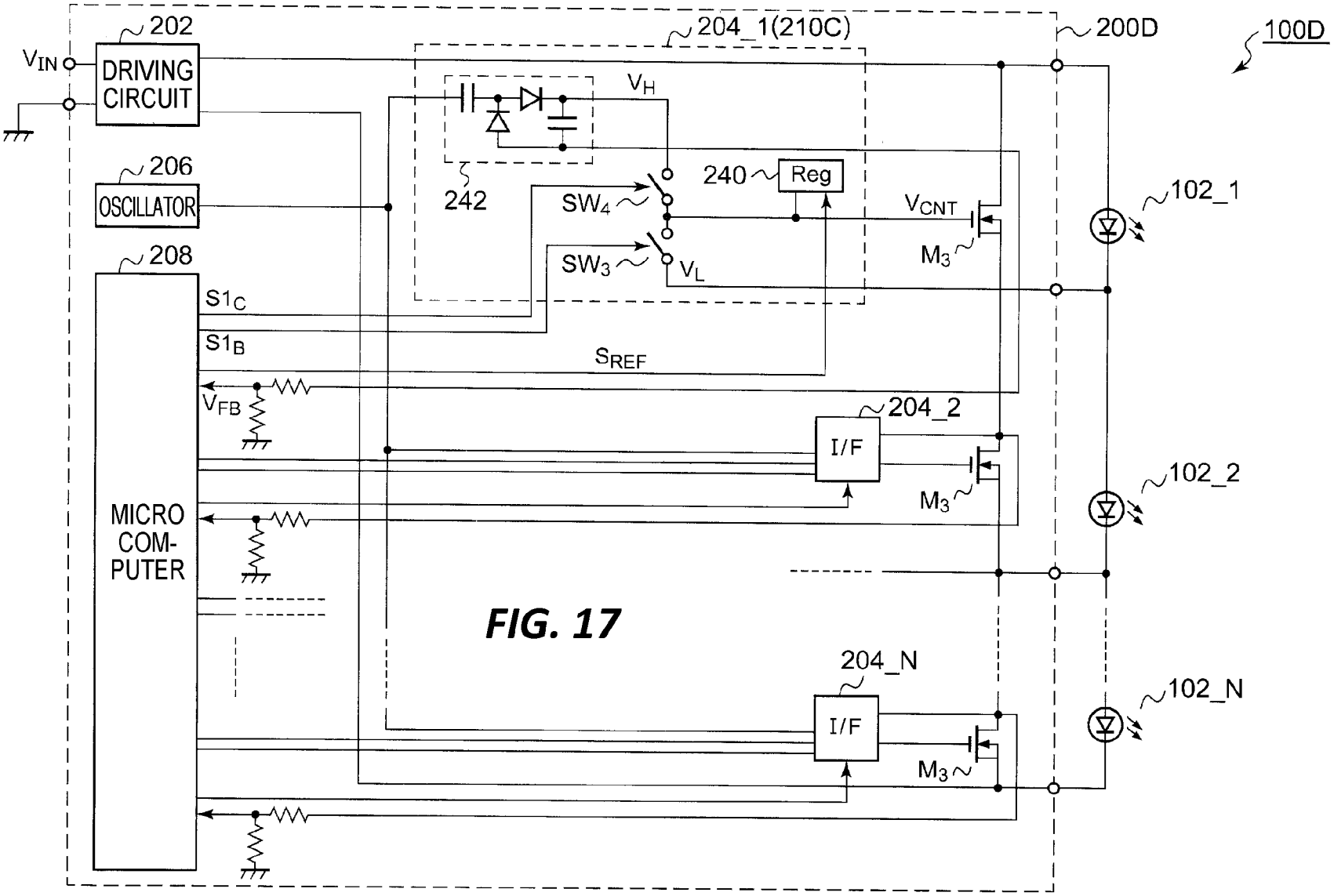
FIG. 17 is a block diagram of an illumination device including a plurality of light sources.

FIG. 17 is a block diagram of an illumination device 100D including a plurality of light sources 102. The illumination device 100D includes a plurality of light sources 102_1 to 102_N and a lighting circuit 200D thereof. The light source 102 is, for example, an LED or an LD, and a plurality of light sources 102_1 to 102_N are connected in series.

The lighting circuit 200D includes a plurality of shaft transistors $M_3$, a driving circuit 202, a plurality of interface circuits 204_1 to 204_N, an oscillator 206, and a microcomputer 208.

Each of the shaft transistors $M_3$ is connected to both ends of the corresponding light source 102. Further, each of the interface circuits 204 drives the corresponding shaft transistor $M_3$. The interface circuit 204 corresponds to the clamp circuit 210C of FIG. 11.

The microcomputer 208 is a controller that controls the lighting circuit 200D in an integrated manner, and controls the lighting/extinguishing of each of the plurality of light sources 102_1 to 102_N based on information from ECU on the vehicle side which is not illustrated.

The light source 102_1, the interface circuit 204_1, and the microcomputer 208 are considered. The interface circuit 204 includes a third switch $SW_3$, a fourth switch $SW_4$, a regulator 240, and a charge pump 242. The regulator 240 and the microcomputer 208 correspond to the feedback circuit 232 of FIG. 12. That is, the feedback circuit 232 is configured with a digital controller and an analog output unit. The former corresponds to the microcomputer 208 and the latter corresponds to the regulator 240. The microcomputer 208 generates a voltage command value $S_{REF}$ such that the feedback voltage $V_{FB}$ obtained by dividing the drain voltage of the shaft transistor $M_3$ is fed back and the feedback voltage $V_{FB}$ is close to a target voltage defining the clamp level $C_L$. The regulator 240 generates the control voltage $V_{CNT}$ corresponding to the voltage command value $S_{REF}$ at the control terminal of the shaft transistor $M_3$. The charge pump 242 receives a clock signal from the oscillator 206, performs a boost operation, and generates a high voltage $V_H$.

According to this illumination device 100D, a plurality of light sources 102_1 to 102_N may be independently controlled. The interface circuit 204 may be configured with the above-described arbitrary clamp circuit 210.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A lighting circuit of a light source, comprising:

a driving circuit configured to generate a driving current to be supplied to the light source; and a clamp circuit configured to receive an input signal oscillating between an on signal and an off signal, wherein the clamp circuit is further configured (i) to be enabled to clamp a voltage between both ends of the light source to a clamp level which is defined to be higher than zero and lower than a threshold voltage of turning-on/off of the light source in a first period when the input signal is the off signal, and (ii) to be disabled to apply substantially an entire amount of the driving current to the light source in a second period when the input signal is the on signal.

2. The lighting circuit of claim 1, wherein, in response to an extinguishing instruction of the light source, the clamp circuit immediately reduces the voltage between the both ends of the light source to zero, and then clamps the voltage to the clamp level.

3. The lighting circuit of claim 1, wherein the clamp circuit includes a first switch and a clamp resistor provided in series on a first path that is in parallel with the light source, and when a resistance value of the first path is R1, the threshold voltage of the light source is VTH, and the driving current is IDRV, a relation of $O<R1\times IDRV<VTH$ is satisfied.

4. The lighting circuit of claim 1, wherein the clamp circuit includes a first switch provided on a first path in parallel with the light source, and when a resistance value of the first path is R1, the threshold voltage of the light source is VTH, and the driving current is IDRV, a relation of $O<R1\times IDRV<VTH$ is satisfied.

5. The lighting circuit of claim 1, wherein the clamp circuit further includes a second switch provided on a second path that is in parallel with the light source, and the second switch is turned on immediately after an extinguishing instruction of the light source, and is turned off before a lighting instruction of the light source.

6. The lighting circuit of claim 1, wherein the clamp circuit further includes:

a shaft transistor provided between the both ends of the light source; and a transistor control circuit configured to generate a voltage of a control terminal of the shaft transistor such that a voltage between the both ends of the light source becomes the clamp level in a period in which the light source is to be turned off.

7. The lighting circuit of claim 6, wherein the transistor control circuit includes a feedback circuit which brings the voltage between the both ends of the light source close to the clamp level by feedback.

8. The lighting circuit of claim 6, wherein the transistor control circuit includes a constant voltage circuit provided between the control terminal of the shaft transistor and a high potential side end.

9. The lighting circuit of claim 6, wherein the transistor control circuit further includes a third switch provided between the control terminal of the shaft transistor and a low potential side end of the light source, or between the control terminal of the shaft transistor and a low voltage terminal to which a predetermined low voltage is supplied.

10. The lighting circuit of claim 6, wherein the transistor control circuit further includes a fourth switch provided between the control terminal of the shaft transistor and a high potential side end of the light source, or between the control terminal of the shaft transistor and a high voltage terminal to which a predetermined high voltage is supplied.

11. A lighting circuit of a light source, comprising:

a driving circuit configured to generate a driving current to be supplied to the light source;

a first switch and a clamp resistor provided in series on a first path that is in parallel with the light source;

a second switch provided on a second path that is in parallel with the light source and the first path; and a controller configured to control the first switch and the second switch such that, the controller provides an input signal oscillating between an on signal and an off signal, wherein the controller is further configured to (i) turn on the first switch to clamp a voltage between both ends of the light source to a clamp level which is defined to be higher than zero and lower than a threshold voltage of turning-on/off of the light source in a first period when the input signal is the off signal, and (ii) to turn off the first switch to apply substantially an entire amount of the driving current to the light source in a second period when the input signal is the on signal.

12. The lighting circuit of claim 11, wherein the controller turns on the first switch in an extinguishing period of the light source and turns off the first switch in a lighting period of the light source, and the controller turns on the second switch immediately in response to an extinguishing instruction of the light source, and turns off the second switch before a lighting instruction of the light source.

13. A vehicular lamp comprising:

a light source; and the lighting circuit of claim 1 configured to drive the light source.

14. The vehicular lamp of claim 13, wherein the light sources are plural.

* * * * *